United States Patent [19]

Fraioli

[11] 4,432,727

[45] Feb. 21, 1984

[54] GAS-FIRED INFRARED PROJECTION HEATER

[76] Inventor: Joseph Fraioli, 8 Seymour Pl., White Plains, N.Y. 10605

[21] Appl. No.: 420,927

[22] Filed: Sep. 21, 1982

[51] Int. Cl.[3] ..... F23D 23/00

[52] U.S. Cl. ..... 432/227; 432/175; 432/222; 431/347; 126/91 A; 126/92 AC

[58] Field of Search ..... 432/227, 222, 175; 431/326, 328, 347; 126/91 A, 91 R, 92 A, 92 AC, 92 C

[56] References Cited

U.S. PATENT DOCUMENTS

| | | | |
|---|---|---|---|
| 2,495,386 | 1/1950 | Peregrine | 432/222 |
| 2,601,299 | 6/1952 | Kennedy | 431/347 |
| 3,437,322 | 4/1969 | Flynn | 432/222 |
| 3,690,626 | 9/1972 | Vernazza | 432/222 |
| 3,810,732 | 5/1974 | Koch | 126/92 AC |
| 3,825,406 | 7/1974 | Heath | 432/222 |
| 3,954,388 | 5/1976 | Hildebrand | 126/92 AC |
| 4,034,739 | 7/1977 | Boekelman | 432/227 |
| 4,202,661 | 5/1980 | Lazaridis et al. | 432/175 |

*Primary Examiner*—Henry C. Yuen
*Attorney, Agent, or Firm*—Michael Ebert

[57] ABSTRACT

A gas-fired infrared heater for projecting an infrared beam in a radiation pattern having a predetermined geometry for irradiating the surface of a food product or other body to effect uniform heating thereof at a rapid rate. The heater is constituted by a refractory assembly formed by a stack of identical slabs having a bore therethrough to receive the cylinder of a controllable ribbon-type gas-air burner from whose longitudinal slot is emitted a sheet of flame. Each slab is provided with a sector-shape channel cut in one face thereof to define a fin and side walls that diverge from the bore to create a flattened IR radiation horn whose mouth is aligned with the burner slot, whereby the surface of the assembly on which the flame impinges is heated to a temperature level causing this surface to emit infrared energy. The parallel array of radiation horns created by the assembly produces a radiation pattern whose shape depends on the geometry of the channel.

14 Claims, 5 Drawing Figures

GAS-FIRED INFRARED PROJECTION HEATER

BACKGROUND OF INVENTION

This invention relates generally to the heating of products with infrared (IR) energy, and more particularly to a gas-fired IR heater for projecting an IR beam in a radiation pattern having a predetermined geometry for irradiating the surface of the product to effect uniform heating thereof at a rapid rate.

The transfer of heat takes place by three processes: conduction, convection and radiation. In conduction, heat is transferred through a body by the short range interaction of molecules and/or electrons. Convection involves the transfer of heat by the combined mechanisms of fluid mixing and conduction. In radiation, electromagnetic energy is emitted toward a body and the energy incident thereto is absorbed by the body to raise its temperature. Radiant heating therefore differs from both convection and conduction heating, for the presence of matter is not required for the transmission of radiant energy.

According to the Stefan-Boltzmann law, the rate of heat transfer between a source of radiated heat whose temperature is $T_s$ and an absorbing body whose temperature is $T_b$ is equal to $T_x^4 - T_b^4$; that is, to the difference between the fourth powers of these temperature values. In convection heating, the rate of heat transfer is proportional only to the temperature difference between the body being heated and the surrounding atmosphere. Hence convection heating is inherently very slow, as compared to the nearly instantaneous effects of radiant heating.

Though an IR heater in accordance with the invention may be used throughout the full range of heating applications, including industrial processes such as industrial finishing and textile treatment, as well as in annealing, curing and drying operations which require heating, it will mainly be described herein in connection with the heating of food products; for the invention has particular advantages in that context.

While a food product typically undergoes cooking or baking at a temperature in the range of about 140° to 200° F. whose upper value is below the boiling point of water (212° F.), it is nevertheless necessary in a conventional convection oven to establish a much higher oven temperature—usually well over 400° F. The reason for this requirement is that the transfer of heat between the hot atmosphere of the convection oven and the body of food takes place at a fairly rapid rate only when the temperature differential therebetween is great.

If, therefore, the food placed in an oven is initially at room temperature and the oven temperature is held at about 200° F., then as the body of the food becomes warmer and its surface temperature rises to, say, 150° F., the rate of heat transfer as the temperature differential narrows thereafter becomes increasingly slow, and the cooking or baking process is protracted. On the other hand, if the oven temperature is raised to 400° or 500° F. to speed up baking, this means that the entire volume of air in the oven must be at this elevated temperature, and this entails a relatively large energy expenditure. With rising energy costs, this factor adds substantially to the cost of baking and is reflected in the cost of the product to the consumer. Also, with convection ovens, the flow of hot air over the surface of the food product tends to deprive it of moisture and volatile constituents and therefore degrades the quality of the product.

Radiation heaters in present commercial use are of the infrared type, the infrared band of thermal radiation lying within the electromagnetic wave spectrum. The quality and intensity of radiation in the infrared band of 0.7 microns to 400 microns depends on the temperature of the radiating body. If, therefore, the radiating body is a refractory ceramic heated by a gas-fired jet burner, one can only accurately adjust the quality and intensity of the IR radiation if it is possible to carefully control the operation of the gas-fired burner.

Despite the fact that IR heaters are much more economical to operate and act with extreme rapidity, and IR heaters are therefore far superior in this regard to convection ovens for cooking or baking food, they have enjoyed limited success in the baking industry. The reason for this is that commercially available gas-fired IR heaters are relatively difficult to control and also give rise to an uneven baking action.

Effective infrared heating depends not only on the radiant source temperature but also on what is referred to as the "geometric view factor." This factor determines the relationship between the pattern of IR radiation and the surface of the product being heated. With the typical IR heating arrangement, portions of the product to be heated are more completely exposed to IR rays and will be heated more rapidly to a high temperature than those portions that are not as fully exposed. As a consequence, the product may not be properly baked and may not be commercially saleable.

This drawback of IR heating with existing equipment is recognized in the article "Radiant Convection Heating—A Marriage of Two Systems" by H. J. Bennett, which appears in the journal *Industrial Gas* for February 1976. In order to overcome the uneven heating experienced with IR heating, the author proposes combining an IR heater with a convection heater so as to provide a heating technique somewhat faster than convection heating, yet with the uniformity and controlled temperature characteristics of convection heating.

The fact is, however, that the synthesis of IR and convection heating represents a compromise that is not entirely satisfactory, for it requires much more energy than IR heating and also a confined oven as well as separate controls for the heater and the over.

Ideally, with a food product, such as dough to be baked, having an exposed surface of given dimensions, the geometry of the IR beam impinging on this surface should be such as to impinge on all points thereon IR rays of equal intensity so that the baking is uniform throughout the body of the food. But existing IR heaters are incapable of producing an IR radiation pattern of uniform flux density which is so shaped as to uniformly irradiate and heat a given food product.

SUMMARY OF INVENTION

In view of the foregoing, the main object of this invention is to provide an infrared heater for projecting an IR beam in a radiation pattern having a predetermined geometry for irradiating the surface of a food or other body to effect uniform heating thereof at a rapid rate.

More particularly, an object of this invention is to provide an infrared heater which makes use of a refractory assembly heated by a ribbon-type cylindrical gas-air burner producing a sheet of flame whose intensity may be adjusted to any desired level and maintained at that level, whereby the intensity of IR radiation emitted by the assembly may be accurately controlled.

Also an object of the invention is to provide an IR heater which is angularly adjustable to project a radiation pattern having a predetermined geometry in any desired direction.

Still another object of this invention is to provide a gas-fired IR heater which may be manufactured at low cost and which in operation is economical of fuel.

Briefly stated, these objects are attained in a gas-fired infrared beam in a radiation pattern having a predetermined geometry for irradiating the surface of a food product or other body to effect uniform heating thereof at a rapid rate. The heater is constituted by a refractory assembly formed by a stack of identical slabs having a bore therethrough to receive the cylinder of a controllable ribbon-type gas-air burner from whose longitudinal slot is emitted a sheet of flame. Each slab is provided with a sector-shape channel cut in one face thereof to define a fin and side walls that diverge from the bore to create a flattened IR radiation horn whose mouth is aligned with the burner slot, whereby the surface of the assembly on which the flame impinges is heated to a temperature level causing this surface to emit infrared energy. The parallel array of radiation horns created by the assembly produces a radiation pattern whose shape depends on the geometry of the channel.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
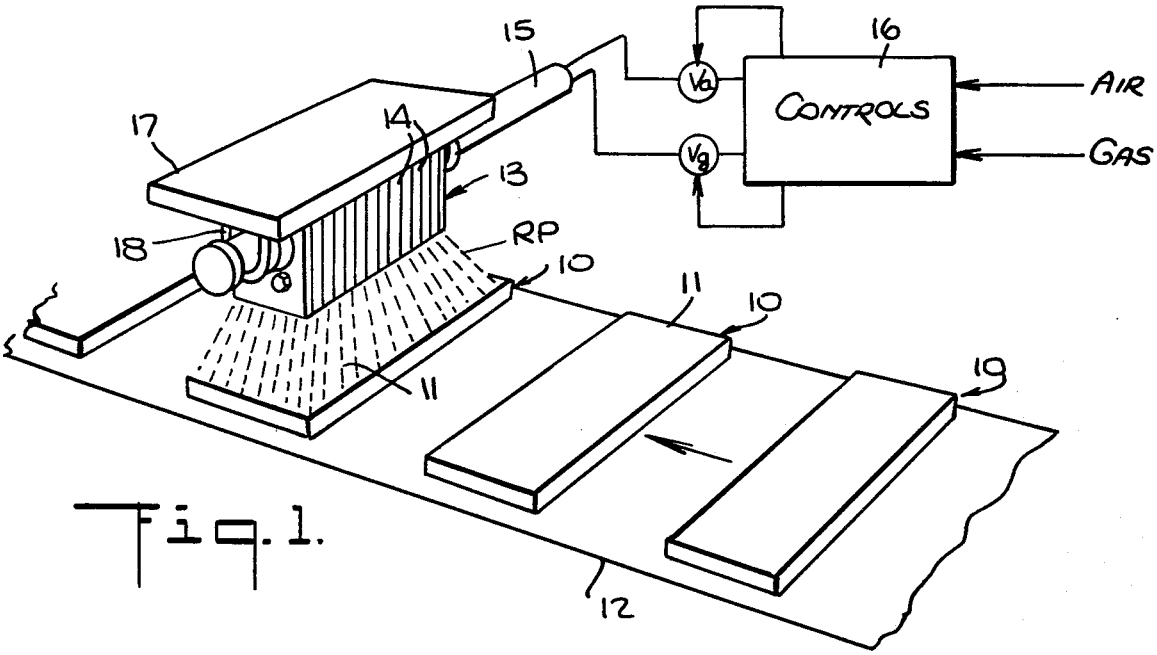
FIG. 1 illustrates in perspective a gas-fired IR heater in accordance with the invention arranged to irradiate a bakery product.

The General Arrangement:

Referring now to FIG. 1, there is illustrated a gas-fired IR projection heater in accordance with the invention which is set up to project an IR bean whose radiation pattern RP is of predetermined geometry and of substantially uniform flux density. The pattern shown is wedge-shaped and has a rectangular area which grows progressively larger as one moves away from the heater.

The food products 10 being heated are shown as dough formed into a rectangular body, the face 11 of the dough having a rectangular surface. These products are conveyed by a belt 12 to pass under the IR heater and to dwell thereunder for a period sufficient to bake the dough. The relationship of the radiation pattern RP to the surface of face 11 is such that the entire surface is uniformly irradiated to effect an even baking action with IR rays.

As will later become apparent, the geometry of the beam may be shaped to conform to baking requirements, and the specific shape shown is only for purposes of illustration.

The IR radition heater is constituted by an assembly 13 formed by a stack of identical slabs 14 composed of refractory material, each slab defining a flattened IR radiation horn, so that the parallel array of such horns created by the assembly produces the desired radiation pattern.

The assembly 13 has a bore therein which passes through the stack of refractory slabs, into which bore is extended the cylinder 15 of a ribbon-type air-gas burner to be later described in greater detail, the cylinder 15 having a longitudinal slot from which is ejected a sheet of flame that impinges on the surface of the assembly to produce a high density flux of maximum radiance. The flame is not the source of infrared radiation, for its function is to heat the surface of the refractory to a temperature level (i.e., 1800° to 2200° F.) at which the refractory then emits infrared energy in the micron range to effect the desired heating of the product subjected to the IR radiation pattern.

As the temperature of the refractory surface is increased, the maximum IR radiation occurs at shorter wavelengths and has a much higher intensity, with an increasingly greater portion of the radiation occurring nearer the visible range in the electromagnetic spectrum. Infrared rays travel in a straight line until they strike an absorbing surface; hence radiant heat follows the same physical laws as light waves and travel at the same speed.

The cylinder of the burner is supplied with a mixture of air and gas through a mixing and control system 16 which makes it possible automatically to adjust through Valves $V_a$ and $V_g$ the ratio of gas to air to provide the desired stoichiometric ratio and to maintain this ratio at an adjusted flow rate, so that one may accurately vary the intensity of heat produced by the burner and the resultant temperature of the refractory surface of the assembly.

Figure 3:
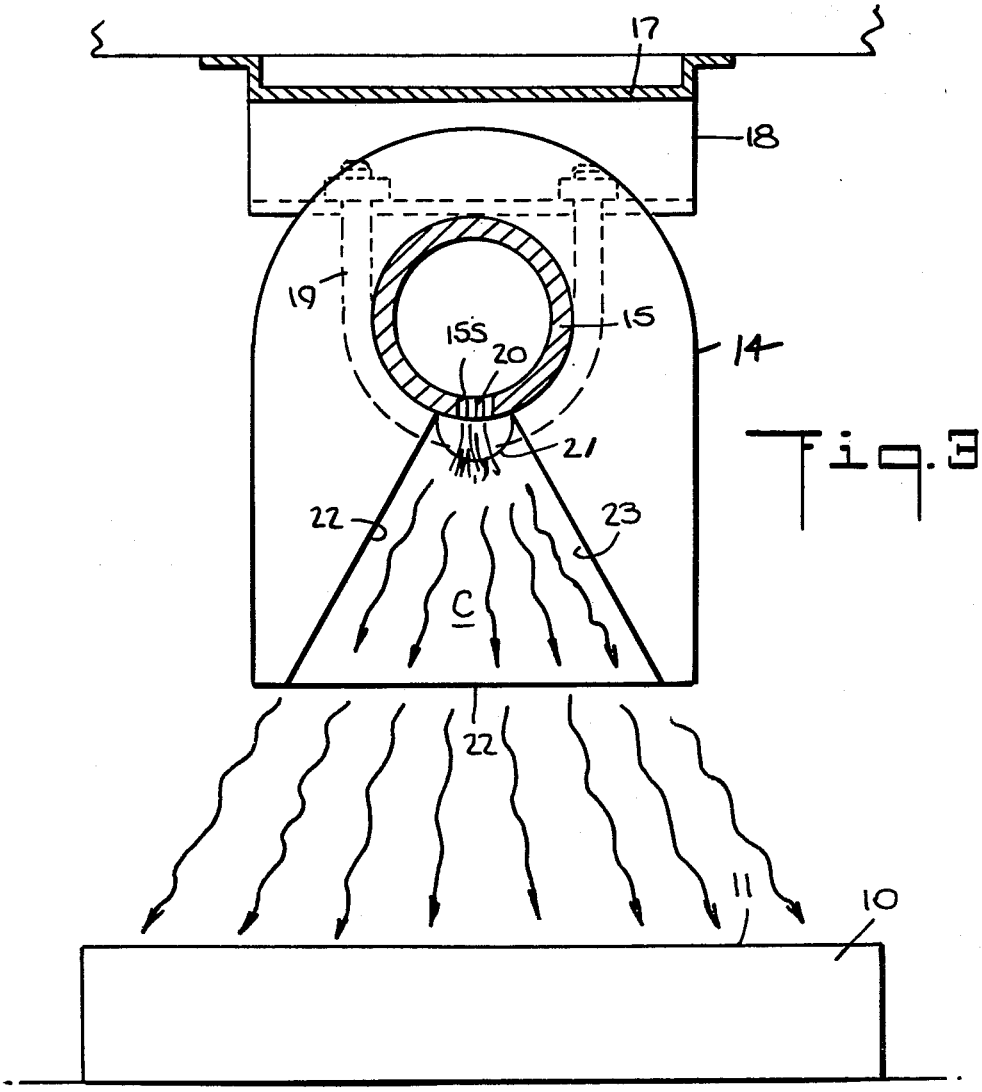
FIG. 3 is a transverse section through the heater.
Figure 2:
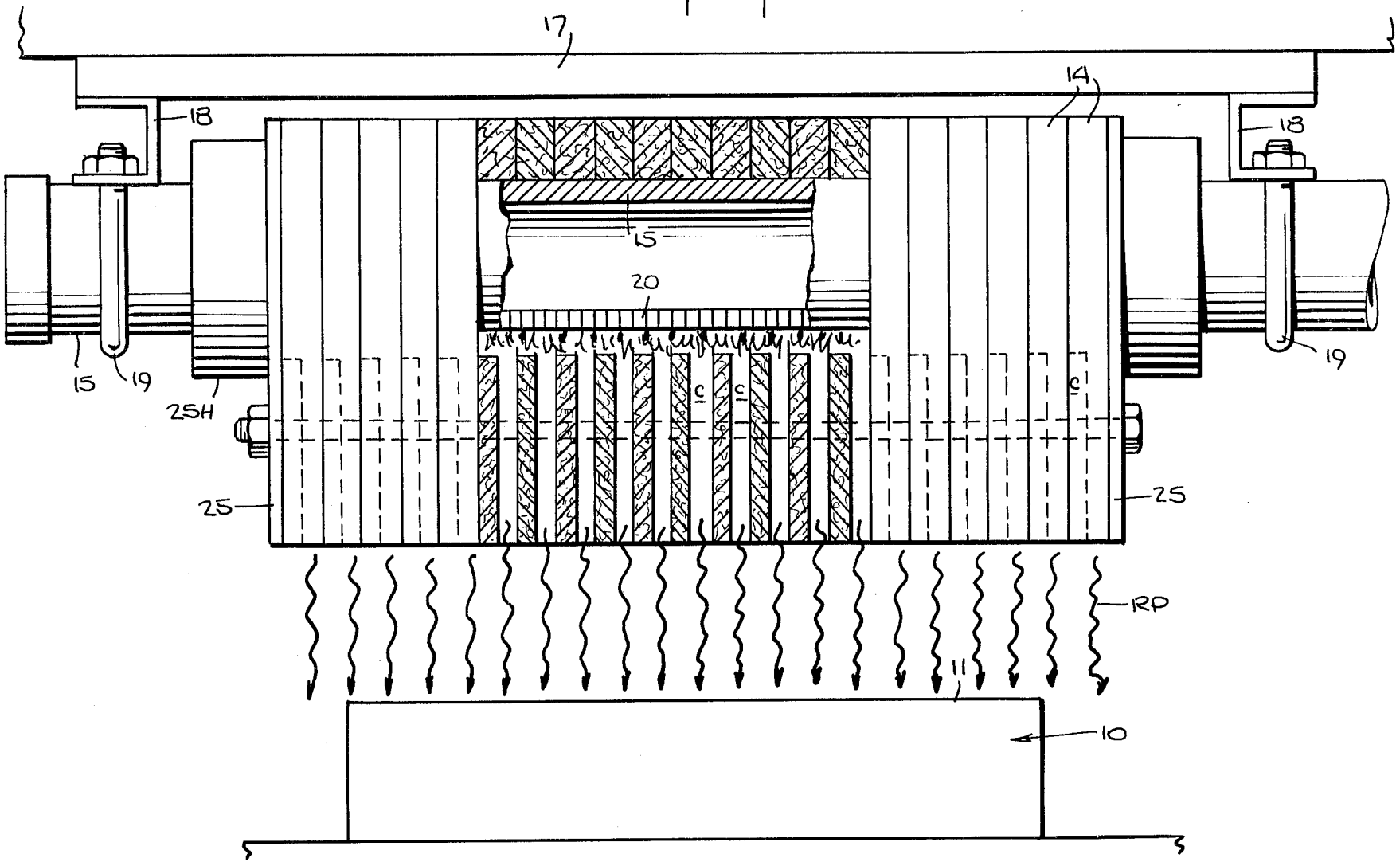
FIG. 2 is an elevational view of the IR heater.

The IR Burner:

Referring now to FIGS. 2 and 3 which show the IR heater in greater detail, it will be seen that cylinder 15 is mounted below a supporting frame 17 by a pair of brackets 18 provided with loops 19 which encircle the cylinder.

Cylinder 15, as best seen in FIG. 3, is provided with a longitudinally extending slot 15S occupied by a stack of corrugated ribbons 20. The corrugated ribbon stack creates an array of minute jet openings through which the gas-air mixture is forced. The configuration of the ribbons is such as to provide two distinct types of jet ports, one being a main flame jet port which is of the high velocity type causing the gas-air mixture to project with sufficient energy to form a long flame, the others on either side of the main flame jet port being pilot jet ports of the low velocity type to produce relatively short flames for sustaining the long main flame. Because of the longitudinally-extending slot arrangement and the myriad jet openings created by the ribbon, the projected main flame is not composed of discrete jets, but assumes a sheet-like form.

Ribbon-burners of this type are manufactured by Flynn Burner Corporation of New Rochelle, N.Y. and are disclosed in greater detail in U.S. Pat. Nos. 2,499,482; 2,521,988; 3,499,720, 3,437,322; 3,996,213 and 4,042,317.

Figure 4:
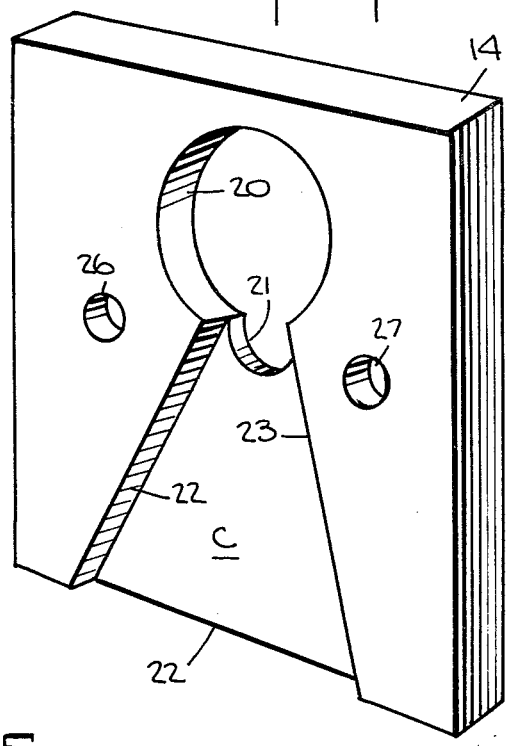
FIG. 4 is a perspective view of one of the slabs in the refractory assembly.

Each slab 14, as shown in FIG. 4, is composed of refractory material, a preferred material for this purpose being "Cera Form," a refractory produced by Johns-Manville of Denver, Colorado made from a wet slurry formulation that includes refractory fibers and multi-component binder systems. Thus "Cera Form"

type 103 includes Alumina (39.6%) and Silica (50.7%). Because the material can be molded, it can be made into the special shapes called for in the present application.

Slab 14 has a hole 20 therein having a lobe extension 21 which, when the burner cylinder 15 is received within this hole, is aligned with the ribbon slots 15S so that the flame is projected into this lobe to heat the surface of the refractory material on which the flame impinges. A sector-shaped channel C is cut into one face of slab 14 to define on the opposing face a fin 22 and inclined side walls 23 and 24 which diverge from lobe 21.

Thus when slabs 14 are stacked in the assembly, each channel C is covered by the fin 22 of the adjacent slab to create a flattened radiation horn whose mouth is aligned with the slot of the burner cylinder 15. The slabs in the assembly are tightly clamped together by end plates 25, as shown in FIG. 2, which have a hole to receive the cylinder and bores to receive bolts which pass through corresponding bores 26 and 27 in the slabs, each end plate having a collar 25H.

The stack therefore provides a parallel array of radiation horns to produce a radiation pattern RP which depends on the geometry of channels C which define the individual horns. The shape of channels C is made such as to provide the desired pattern. Thus the sector shown in FIG. 3 for channel C may be made narrower or wider to meet particular requirements.

Because cylinder 15 is secured to a supporting frame by bracket loops 19 which are tightened by nuts, the angular position of the heater assembly relative to the frame may be adjusted to assume any desired angle in order to project the IR radiation pattern in a desired direction, depending on heating requirements. And while the slabs 14 of refractory material are shown in rectangular form, they may be in other geometric shapes, such as oblong or circular.

Figure 5:
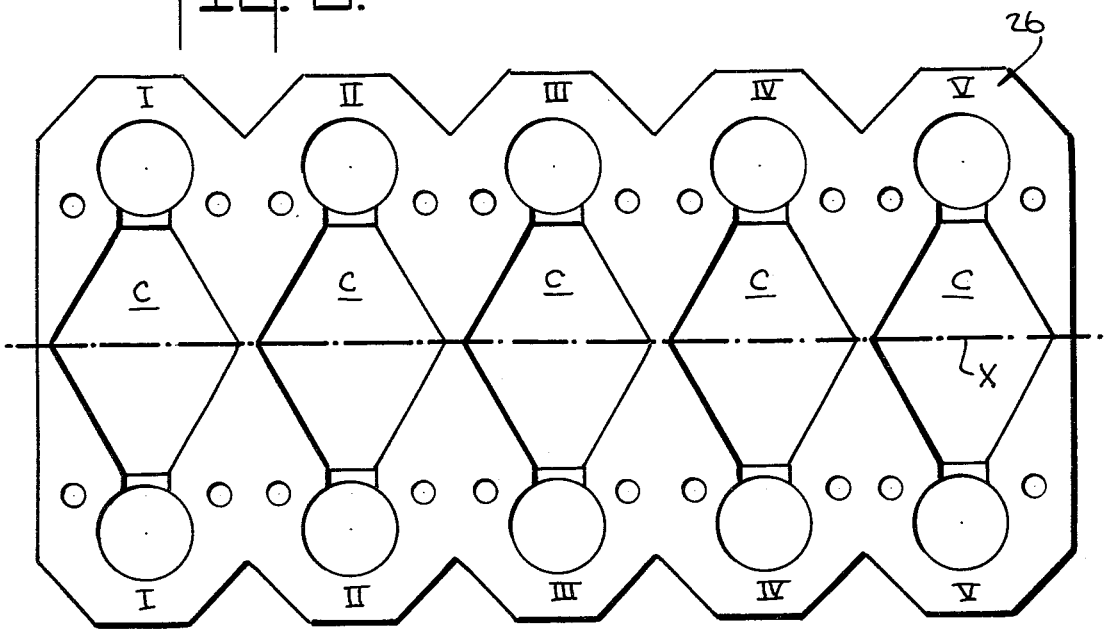
FIG. 5 shows in plan view a molded slab having multiple bores and sector-shaped channels.

Modifications:

In practice, instead of a stack composed of single slabs with a single gas-fired cylinder passing through the stack, one may mold of refractory material, as shown in FIG. 5, multiple-section slabs, the molding being such as to provide two opposing sets 26 thereof which are joined together and are later cut apart along line X. Each set is composed in the example shown, of five (I to V) sections, each having a cylinder-receiving bore 27 and a sector-shaped channel C communicating therewith.

Thus a gas-fired IR heater which makes use of a refractory set as shown in FIG. 5 would have five ribbon-type gas-fired cylinder burners and be adapted to produce a very board radiation pattern resulting from the combined effect of the radiation horns created by the five sections.

While there has been shown and described a preferred embodiment of a gas-fired infrared projection heater in accordance with the invention, it will be appreciated that many changes and modifications may be made therein without, however, departing from the essential spirit thereof. Thus while a fibrous refractory has been disclosed, in practice the infrared emitting material may be of a ceramic or other composition as long as it assumes the form of slabs having sector-shaped channels. And while a heater in accordance with the invention does not require an enclosure to confine heated air as in a convection oven, an enclosure may be used to minimize the loss of heat from the atmosphere heated by the irradiated body, for this atmosphere is then prevented from escaping. Also, instead of a ribbon-type burner to produce a longitudinally-extending source of thermal energy to activate the refractory assembly, an electrical heating rod may be used for this purpose.

Advantages:

In a conventional gas-fired infrared heater in which the surface of a refractory IR emitter is heated by a gas-fired jet burner, the nature of the burner is such that one cannot control the flame throughout a board range extending from an extremely low level to a very high level. Hence the minimum flame setting of the burner is relatively high and the IR intensity at this setting is also high.

As a consequence, when a conventional gas-fired IR heater is to be used to heat dough or any other body to a relatively low temperature level no higher than, say, 300° F., in order to attain the desired level of body heat, one must locate the infrared emitter a substantial distance from the body, say, 20 inches or more, to avoid overheating. The resultant infrared beam directed toward the body then has rays in the central region thereof which are almost perpendicular to the body. The charging rays in the outer region on either side of the central region are more or less inclined and therefore travel a longer distance, the intensity of the rays decreasing as the square of the distance. Hence the body in the area impinged on by the rays from the central region is raised to a higher temperature than the areas impinged on by the rays from the outer region, this action producing uneven heating.

But with an infrared heater in accordance with the invention in which a gas-fired ribbon type cylinder is used to heat the refractory IR emitter, one may operate this burner with an extremely small flame without losing the flame. This makes it possible to reduce the intensity of infrared radiation to a level making it feasible to bring the infrared heater as close as four inches to the surface of the body to be heated, in which case all infrared rays impinging on the body travel a very short distance to effect uniform heating thereof.

I claim:

1. A gas-fired infrared heater for projecting an infrared beam in a radiation pattern having a predetermined geometry for irradiating the surface of a body to effect substantially uniform heating thereof, said heater comprising:

A a gas-fired burner constituted by a cylinder supplied with a combustible air-gas mixture, said cylinder having a longitudinal slot occupied by corrugated ribbons whereby emitted therefrom is a sheet of flame; and B an assembly formed by a stack of identical slabs of refractory material having a bore extending therethrough to receive said cylinder, each slab having a sector-shaped channel cut into one face thereof to define a fin parallel to said one face and side walls that diverge from the bore to create a flattened infrared radiation horn whose mouth is aligned with the burner slot whereby the surface of the assembly on which the flame impinges is heated to a temperature level causing it to emit infrared radiation, the parallel array of radiation horns created by the assembly producing a radiation pattern whose shape depends on the geometry of the channel.

2. A heater as set forth in claim 1, wherein the bore in each slab has a lobe extension aligned with the slot of the burner.

3. A heater as set forth in claim 1, wherein said burner is supplied with air and gas through a control system which adjusts and maintains the ratio of air to gas and the flow rate of the resultant mixture fed into the cylinder to vary the intensity of the sheet of flame to provide infrared emission of a desired intensity.

4. A heater as set forth in claim 1, wherein said stack is provided with end plates which are joined together by bolts passing through holes in the slabs to clamp the slabs together.

5. A heater as set forth in claim 4, wherein each end plate has a collar projecting therefrom through which the cylinder is inserted.

6. A heater as set forth in claim 5, wherein the opposite ends of the cylinder extend beyond the assembly and are supported from a frame by brackets having loops which engage the cylinder ends.

7. A heater as set forth in claim 6, wherein the angular orientation of the assembly relative to the frame is adjustable to vary the direction of the radiation pattern.

8. A heater as set forth in claim 1, wherein each slab is molded of refrac tory fibers dispersed in a binder system.

9. A heater as set forth in claim 8, wherein said fibers include alumina and silica.

10. A heater as set forth in claim 1, wherein each slab is composed of a series of like sections each having a bore t-erein to receive a separate cylinder, each section having a sector-shaped channel communicating with its bore to define a radiation horn.

11. A heater as set forth in claim 1, wherein said body to be heated is dough to be baked, and said radiation pattern is shaped to uniformly irradiate the entire surface of the dough.

12. A gas-fired infrared heater for projecting an infrared beam in a radiation pattern having a predetermined geometry for irradiating the surface of a body to effect substantially uniform heating thereof, said heater comprising:

A a gas-fired burner constituted by a cylinder supplied with a combustible air-gas mixture, said cylinder having a longitudinal slot occupied by corrugated ribbons whereby emitted therefrom is a sheet of flame; and B a refractory emitter having a bore therethrough to receive said cylinder, said emitter having a radiation horn formed therein whose mouth is aligned with the slot of the burner whereby the surface of the emitter on which the flame impinges is heated to a temperature level causing it to emit infrared radiation which is projected from the emitter to irradiate the body.

13. A heater as set forth in claim 1, wherein said bore has a lobe extension aligned with the slot of the burner.

14. A heater as set forth in claim 12, wherein said burner is supplied with air and gas through a control system which adjusts and maintains the ratio of air to gas and the flow rate of the resultant mixture fed into the cylinder to vary the intensity of the sheet of flame to provide infrared emission of a desired intensity.

* * * * *